United States Patent [19]

Martin

[11] Patent Number: 4,519,858

[45] Date of Patent: May 28, 1985

[54] SPLICER

[75] Inventor: John R. Martin, Rockford, Ill.

[73] Assignee: Martin Automatic, Inc., Rockford, Ill.

[21] Appl. No.: 587,243

[22] Filed: Mar. 7, 1984

[51] Int. Cl.[3] ..... B65H 19/08

[52] U.S. Cl. ..... 156/64; 156/157; 156/361; 156/494; 156/104; 242/58.4

[58] Field of Search ..... 156/502, 504, 157, 353, 156/361, 494, 358, 64; 242/58.1, 58.4, 58.5

[56] References Cited

U.S. PATENT DOCUMENTS

| | | | |
|---|---|---|---|
| 3,730,811 | 5/1973 | Wendt | 242/58.4 X |
| 3,780,960 | 12/1973 | Tokuno | 242/58.1 |
| 4,113,197 | 9/1978 | Harrington et al. | 156/504 X |
| 4,190,475 | 2/1980 | Marschke | 156/504 X |

OTHER PUBLICATIONS

The Marquip Inc., Tailgrabber Brochure, undated.

*Primary Examiner*—David Simmons

*Attorney, Agent, or Firm*—Allegretti, Newitt, Witcoff & McAndrews, Ltd.

[57] ABSTRACT

The invention includes a new web splicer and new method of web splicing, in many aspects. In a principal aspect, the invention is a new automatic web splicer adapted to splice a new web to the tail of a running web while maintaining web speed and tension of equipment into which the webs are running. The web splicer comprises a frame, an anvil and hammer mechanism, a pair of web guides, a pair of web brake rollers, a pair of brake mechanisms, sensing means, web tensioning means and control means.

18 Claims, 6 Drawing Figures

SPLICER

BACKGROUND AND FIELD OF THE INVENTION

1. Field Of The Invention

This invention relates to web handling equipment and methods, and more particularly to web splicers and methods.

2. Prior Art

Web splicing is employed in many continuous processes for introducing new webs to the processes as old webs expire. A goal or object of web splicing is to introduce a new web without interruption of the process. Another object is to introduce the fresh web without waste of the expiring web, or the leading end (lead) of the new web.

Webs are stored and fed from spools, comprising continuous paper or similar material spirally wound on cores. In the past, web splicers have generally spliced a fresh web onto an expiring web before the expiring web has separated from its core. While this method of splicing is wasteful of the tail of expiring webs, the method has generally been considered necessary to assure no loss of tension in the web. A loose tail means a loss of tension in the tail. Problems with past splicers have included waste as described, failure to maintain sidelay of a fresh web consistent with that of an expiring web, lack of reliability, and complexity.

A notable exception to the described splicers was a predecessor of this invention. This predecessor is illustrated schematically in FIG. 1 of the accompanying drawing. A hammer 10 and anvil 12 of the predecessor were adapted to seize the tail of an expiring web 14. A pair of rollers 16, 18 upstream of the hammer and anvil were adapted to press the tail and the lead 20 of a fresh web together, to adhere the tail to an adhesive strip 22 manually pre-placed on the lead. Loss of tension in the tail as it separated from the core caused an upper drop roller 24 to rise. The rise tripped a switch, causing the hammer 10 to press the tail to the adhesive 22 against the anvil 12, stopping the expiring web 14. The stopping caused extreme movement of a dancer in a web tensioning carriage, tripping another switch and pressing the roller 18 against the fixed idler 16. Simultaneously the hammer 10 released, and the expiring web 14 and the lead 20 moved forward. The dancer fell, tripping the second switch and releasing roller 18.

SUMMARY OF THE INVENTION

An object of the inventors in making this invention was to splice the lead of a fresh web to the tail of an expiring web automatically, repeatably, at high web speed, as near the extreme tail end of the web as possible, and after the tail has separated from the core, without significant loss of web tension or web speed in equipment into which the web is running, and with webs which are of material difficult to handle.

While the predecessor splicer proved useful, the seizing of the tail downstream of the joint to be made between the tail and lead risked continued, uncontrolled movement of the tail in the location where the splice was to be made. Splicing reliability suffered. The seizing of the tail by the hammer and anvil also risked web breakage, since the web was abruptly stopped. The sensing of loss of tension occurred far downstream of the tail, adding to the time required for the splice to be made.

The invention includes a new web splicer and new method of web splicing, in many aspects. In a principal aspect, the invention is a new automatic web splicer adapted to splice a new web to the tail of a running web while maintaining web speed and tension of equipment into which the webs are running. The web splicer comprises a frame, an anvil and hammer mechanism, a pair of web guides, a pair of web brake rollers, a pair of brake mechanisms, sensing means, web tensioning means and control means. All components are mounted to the frame. The hammer mechanism is adapted to automatically hammer the anvil on a command to hammer. The web guides are adjacent the hammer and anvil, and adapted to guide the running web and the new web between the hammer and anvil. The web brake rollers are adjacent the web guides, mounted to the frame for rolling motion, and adapted to be pressed against the web guides to provide tension in the tail of the running web.

The web brake mechanisms are adjacent the web brake rollers. They are adapted to receive a command to brake the web brake rollers and another command to release the web brake rollers. They are also adapted to (a) automatically brake rolling motion of the web brake rollers and press the web brake rollers against the web guides on the command to brake the web brake rollers, and (b) automatically release the web brake rollers for continued rolling motion and freedom from being pressed against the web guides on the command to release the web brake rollers. The frame, anvil, hammer mechanism, web guides, web brake rollers and brake mechanisms are adapted for running of the running web between the hammer and anvil and also adapted for manual placement of an adhesive leading end of the new web between the hammer and anvil.

The sensing means is for sensing and providing a signal of the approach toward the web brake rollers of the tail of the running web. The web tensioning means is for maintaining tension in leaving the web splicer. The control means receives the signal of the approach of the tail from the sensing means, and responsively sends three commands. To the web brake mechanisms, the control means send the command to brake the web brake rollers. To the hammer, after the web brake mechanisms have braked rolling motion of the web brake rollers and pressed the web brake rollers against the web guides, the command is sent to hammer the anvil. To the first web brake mechanism, after the hammer has hammered the anvil, the command is sent to release the web brake rollers.

Thus, the web splicer is adapted to splice the leading end of the new web to the tail of the running web, while the leading end and the tail are between the hammer and anvil.

This new web splicer has proved itself to be accurate and reliable at high web speeds with difficult webs, economical of manufacture, and capable of splicing without loss of tension or speed within three to four inches of the extreme end of an expiring web.

These and other objects, aspects and advantages of the invention are more fully set forth in the detailed description of the preferred embodiment, which follows a brief description of the accompanying drawing.

BRIEF DESCRIPTION OF THE DRAWING

The accompanying drawing includes six figures or FIGS. as follows.

DETAILED DESCRIPTION OF THE PREFERRED EMBODIMENT

Figure 2:
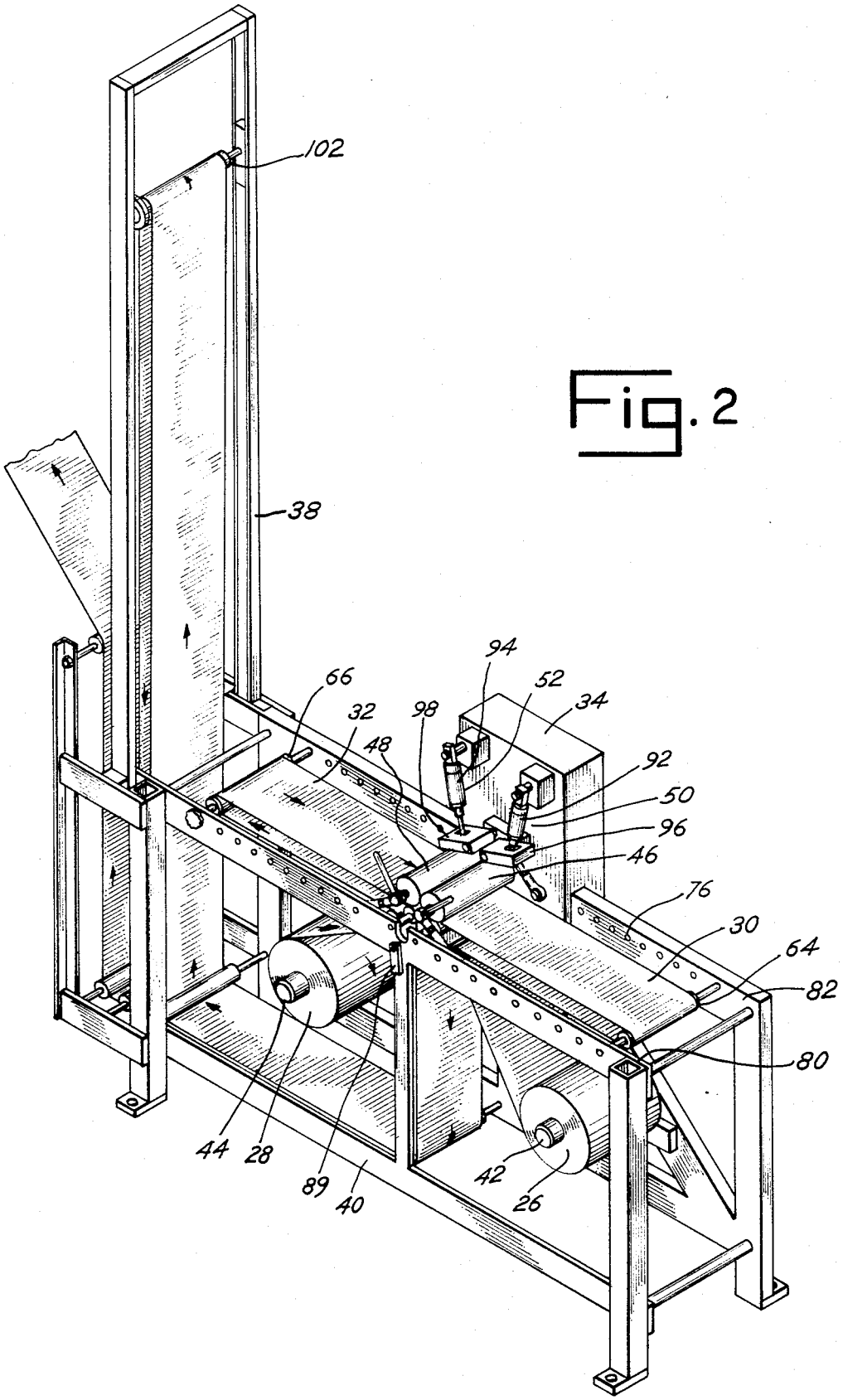
FIG. 2 is a perspective view of a preferred embodiment of the apparatus of the invention, which is a web splicer including in part core chucks for two web spools 26, 28 for two webs 30, 32, a splicer head 34, web guide rollers such as 64, and a dancer carriage 38 on a frame 40.

Referring to FIG. 2 of the accompanying drawing, the preferred embodiment of the apparatus of the invention is a web splicer 25. A frame 40 supports in part a dancer carriage 38, two core chucks 42, 44 for two web spools 26, 28 of the webs 30, 32, a splicer head 34, two web brake rollers 46, 48, two web brake mechanisms 50, 52, and a plurality of web guides such as web guide roller 64.

Figure 3:
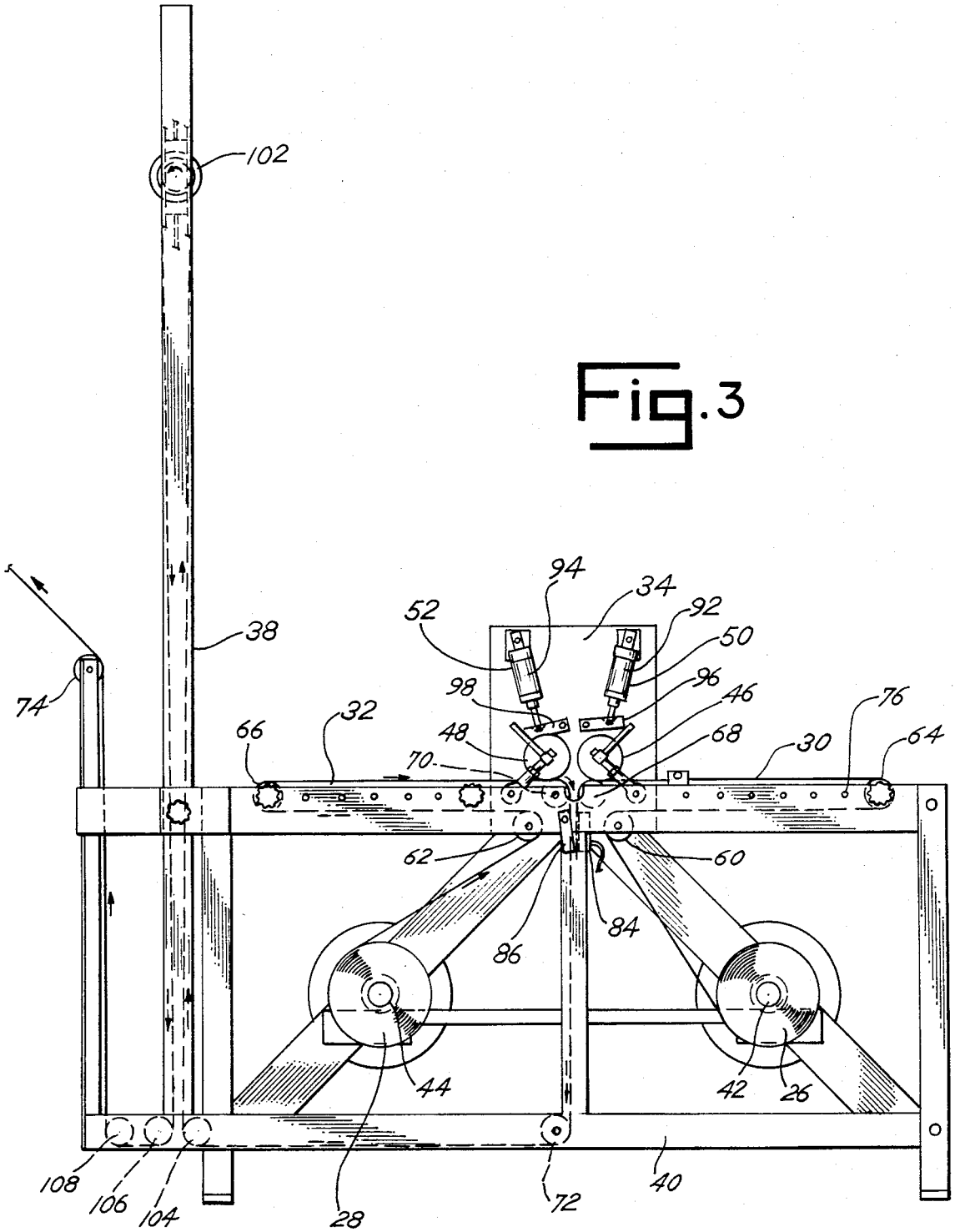
FIG. 3 is a side elevation view of the preferred embodiment of the apparatus of the invention.

The core chucks 42, 44 are bearing mounted on the frame 40 for rotary motion, at horizontally spaced locations, and hold the spools 26, 28 parallel to each other and ready to be unwound. Flywheels 54, 56 mounted to the shafts of the core chucks 42, 44 aid constant speed rotation of the core chucks 42, 44. As best shown in FIG. 3, the webs 30, 32 are unwound from the spools at about 45° angles to the horizontal, toward each other, and toward two rollers 60, 62. The webs 30, 32 pass over the rollers 60, 62 and move away from each other horizontally, to two more rollers 64, 66. The webs circle the rollers 64, 66, and extend horizontally to two further, closely spaced rollers 68, 70. Both webs extend vertically downward between the rollers 68, 70. One of the webs, whichever is at the time being actively unwound, extends to a roller 72 below the rollers 68, 70 and continues, as will be later described, to a roller 74, where it exits the splicer.

Each roller 60, 62, 64, 66, 68, 70, 72, 74 is bearing mounted to the frame 40 for rotation. The rollers 60, 62, 64, 66, 68, 70, 72, 74 are all parallel to each other and to the core chucks 42, 44. The rollers are progressively downstream of each other in number order, and vice versa. The rollers 60, 62, 64, 66, 68, 70, 72, 74 are mounted to the frame 40 in several ways. The rollers 68, 70, 72, 74 are mounted in fixed positions.

Figure 4:
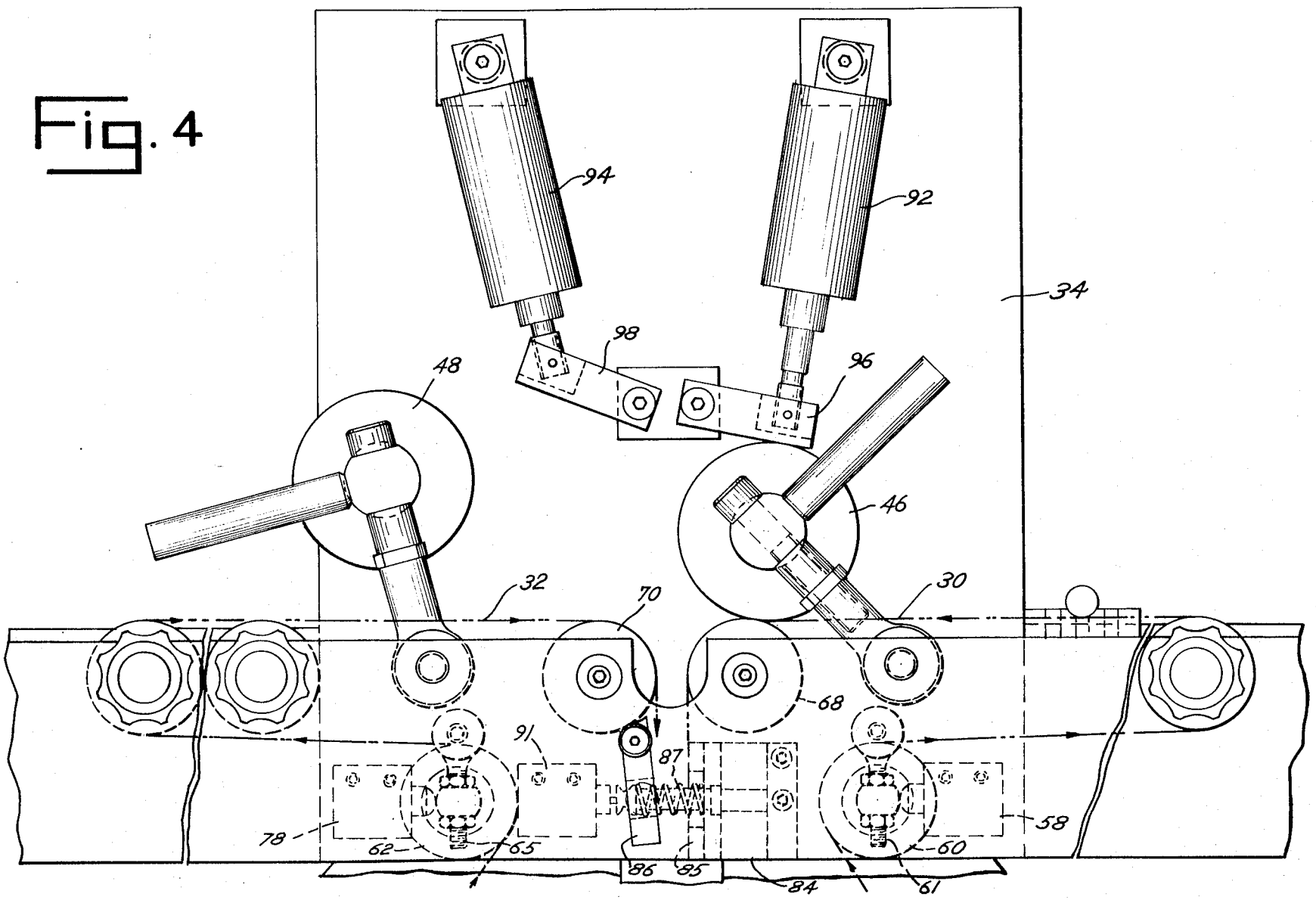
FIG. 4 is a detail view of the preferred embodiment in the area of the splicer head 34.
Figure 5:
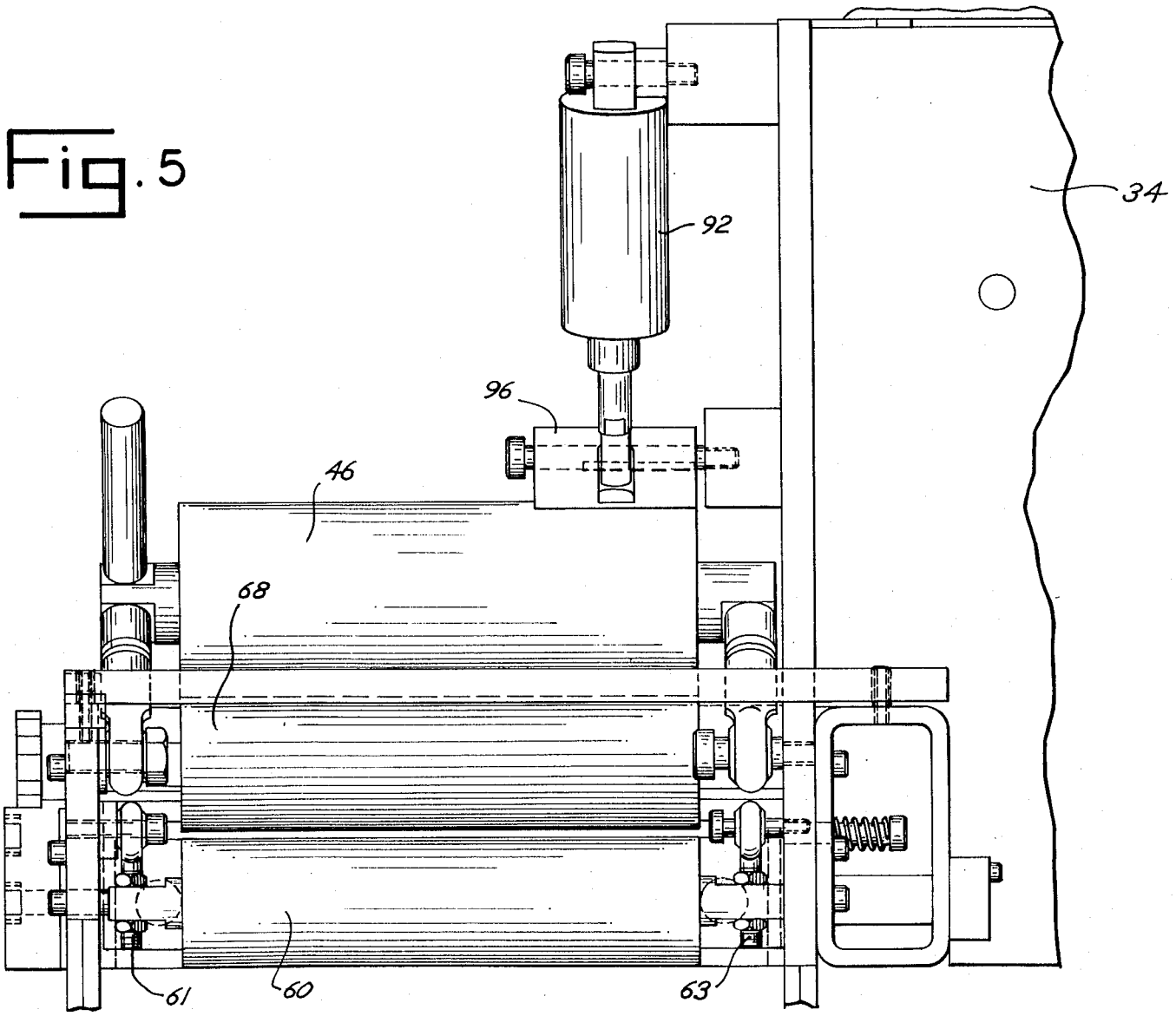
FIG. 5 is an end view of the components of FIG. 4.

The rollers 64, 66 are readily removable from the frame 40, and may be easily mounted in any of a plurality of mounting in the spaced mounting holes 76 along frame bars 80, 82. The rollers 60, 62 are lever mounted and biased, to pivot away from the core chucks 42, 44 in the absence of web tension. The rollers are mounted on mounting levers such as levers 61, 63, 65, as shown in FIGS. 4 and 5. When web tension is present, the rollers 60, 62 are pivoted toward the core chucks 42, 44.

Figure 1:
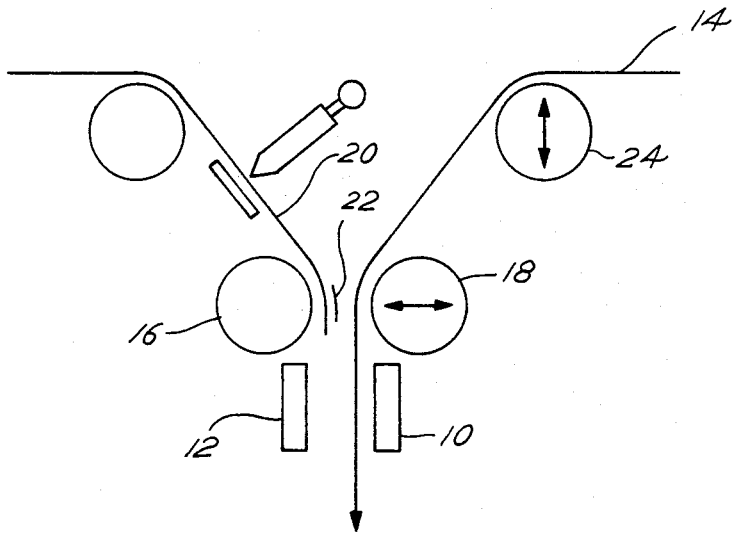
FIG. 1 is a schematic illustration of a predecessor of the present invention.
Figure 6:
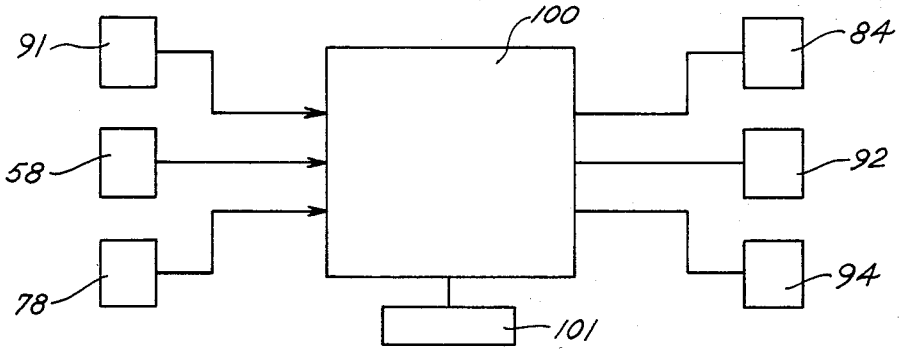
FIG. 6 is a schematic illustration of the pneumatic control circuitry of the preferred embodiment.

Associated with each roller 60, 62 is a frame mounted pneumatic position sensor 58, 78, in FIGS. 4 and 6. Each sensor 58, 78 senses the pivotal movement of its roller 60, 62 caused by the presence or absence of web tension.

The splicer 25 accomplishes splicing of either web 30, 32 to the other, as necessary. For this purpose, the splicer 25 includes a pneumatic hammer 84 frame-mounted below the roller 68, and an anvil 86 frame-mounted below roller 70.

The hammer 84 includes a drivable head 85 capable of movement toward and away from the anvil 86, and a spring 87 biasing the head 85 away from the anvil 86. The head 85 is driven by an air burst. The anvil 86 is pivotably mounted to be driven against a stop by the hammer 87, or manually through an attached lever 89. A position sensor 91, shown in FIGS. 4 and 6 senses the position of the anvil 86.

The running web of webs 30, 32 passes between the hammer 84 and anvil 86. The lead of the web to be spliced to the running web begins between the hammer and anvil, after having been manually positioned there. A strip of two sided adhesive is on the web to be spliced, also between the hammer and anvil.

The web brake rollers 46, 48 are lever mounted to the frame 40 adjacent and above the rollers 68, 70. Each web brake roller 46, 48 is manually pivotable through a range of positions including the position of FIGS. 2 and 3 and the raised position of roller 48 shown in FIG. 4. In the lowered positions of FIGS. 2 and 3, the web brake rollers 46, 48 contact the webs 30, 32 atop the rollers 68, 70. Whichever web is running drives its contacted web brake roller through friction.

The two web brake mechanisms 50, 52 include pneumatic cylinders 92, 94 connected to two brakes or pads 96, 98. The cylinders 92, 94 and brakes 96, 98 are pivotably mounted to the splicer head 34, for pivoting actuation of the brakes toward and away from contact with the web brake rollers 46, 48. In a braking position, as brake mechanism 52 is in FIGS. 2 and 3, the cylinder drives its brake against the underlying web brake roller. The braked web brake roller, if being driven by movement of the web, is slowed and then stopped, as in the driving web. In a non-braking position, as brake mechanism 50 is shown, the cylinder lifts its brake, allowing the underlying web brake roller to be driven by the web, or remain idle, if the web is idle. (Only with the cylinder and brake lifted is the web brake roller manually liftable, as described above).

The splicer head 34 includes controller 100, shown schematically in FIG. 6. The controller 100 receives signals generated by the sensors 91, 58, 78 and controls the brake mechanisms 50, 52 and the hammer 84 in response.

As stated above, the web sensors 58, 78 sense movement of the rollers 60, 62 in response to the presence or absence of web tension. When the webs are threaded through the splicer 25, tension is present. Tension becomes absent when the tail of a running web unwinds to be free of the web spool. Thus, each sensor 58, 78 senses depletion of its web as the web leaves the spool.

When the controller 96 receives a signal from a sensor 58, 78, the controller 96 sends a pneumatic signal or command to the cylinders 92, 94, to apply the brakes 96, 98. The brakes 96, 98 cause the rollers 46, 68, 48, 70 to nip the webs. The controller 100 then sends a pneumatic command to the hammer 84, causing the drivable head 85 to strike the anvil 86. By this time, dependent on the position of the corresponding one of the rollers 64, 66, the tail is only three to four inches long. The strike of the hammer 84 adheres the tail to the lead of the non-running web.

The strike also pivots the anvil 86, causing the sensor 91 to signal the controller 100, thereby reporting the splicing. The controller 100 signals the brake cylinders 92, 94 to retract. The new web is pulled by the tension in the released and then running tail, and the new spool unwinds. The splicer 25 is also partially reset. A new spool may be manually put in the place of the core of the expired spool, and the lead threaded about the splicer to the hammer and anvil, for further splicing. Adhesive may be manually placed on the lead. The cylinder 92 or 94 associated with the new spool may be manually lowered, by manual actuation of controls 101 of the controller 100, to hold the lead of the new spool in proper position. The splicer 25 is then reset, and ready to accomplish another splicer.

At all times of splicer operation and web movement, and especially during the interval when the tail of a running web is free of its spool, a dancer 102 in the dancer carriage 38 maintains tension in the web leaving the splicer 25. Between the rollers 72, 74, the running web is guided by additional rollers 104, 106, 108, and encircles the dancer 102. The movement of the dancer maintains the tension.

The preferred embodiment of the invention is now described. This preferred embodiment constitutes the best mode contemplated by the inventor of carrying out the invention. The invention, and the manner and process of making and using it, have been described in full, clear, concise and exact terms to enable any person skilled in the art to make and use the same. Because the invention may be copied without the copying of the precise details of the preferred embodiment, the following claims particularly point out and distinctly claim the subject matter which the inventor regards as his invention and wishes to protect.

What is claimed is:

1. A web splicer comprising:

a frame;

an anvil mounted to the frame;

a hammer mounted to the frame adapted to automatically hammer the anvil;

a first web guide mounted to the frame adjacent the hammer adapted to guide a first web between the hammer and anvil;

a second web guide mounted to the frame adjacent the anvil adapted to guide a second web between the hammer and anvil;

a web brake roller mounted to the frame adapted to be moved to and from a position of braking contact against the first web guide; and a brake means mounted to the frame for moving the web brake roller to the position of braking contact and thereby brake the first web to a stop, and for releasing the web brake roller.

2. A web splicer as in claim 1 further comprising:

sensor means for sensing a tail of the first web; and control means for, (a) receiving a signal from the sensor means, and responsively (b) sending to the brake means a command to brake the first web, (c) after (a) and (b), sending to the hammer a command to hammer the anvil, and (d) after (c), sending to the brake means a command to release the first web brake roller.

3. A web splicer adapted to splice a new web to the tail of a running web while maintaining web speed and tension of equipment into which the webs are running, the web splicer comprising:

a frame;

an anvil mounted to the frame;

a hammer mechanism mounted to the frame adapted to automatically hammer the anvil on a command to hammer;

a pair of web guides mounted to the frame adjacent the hammer and anvil and adapted to guide the running web and the new web between the hammer and anvil;

a pair of web brake rollers mounted to the frame adjacent the web guides, the web brake rollers being mounted to the frame for rolling motion, and adapted to be pressed against the web guides to brake the webs;

a pair of web brake mechanisms mounted to the frame adjacent the web brake rollers, adapted to receive a command to brake the web brake rollers and another command to release the web brake rollers and also adapted to (a) automatically brake rolling motion of the web brake rollers and press the web brake rollers against the web guides on the command to brake the web brake rollers, and (b) automatically release the web brake rollers for continued rolling motion and freedom from being pressed against the web guides on the command to release the web brake rollers;

the frame, anvil, hammer mechanism, web guides, web brake rollers and brake mechanisms being adapted for running of the running web between the hammer and anvil and also adapted for manual placement of an adhesive leading end of the new web between the hammer and anvil;

sensing means mounted to the frame for sensing and providing a signal of the approach toward the web brake rollers of the tail of the running web;

a web tensioning means mounted to the frame for maintaining tension in web leaving the web splicer; and a control means for, (a) receiving the signal of the approach of the tail from the sensing means, and (b) responsively sending, in response to receipt of the signal, the following commands:

(i) to the web brake mechanisms, the command to brake the web brake rollers, (ii) to the hammer, after the web brake mechanisms have braked rolling motion of the web brake rollers and pressed the web brake rollers against the web guides, the command to hammer the anvil; and (iii) to the web brake mechanisms, after the hammer has hammered the anvil, the command to release the web brake rollers;

the web splicer thereby being adapted to splice the leading end of the new web to the tail of the running web, while the leading end and the tail are between the hammer and anvil.

4. A web splicer as in claim 3 in which the sensing means is mounted to the frame upstream of the web brake rollers.

5. A web splicer as in claim 4 in which the sensing means comprises a sensor, and a web sensor roller mounted to the frame and adapted to move in response to loss of tension in the running web, the sensor being adapted to sense the movement of the web sensor roller.

6. A web splicer as in claim 3 further comprising additional web guides mounted to the frame upstream of the web brake rollers and adapted to be manually adjusted on the frame for adjusting the distance the tail of the running web must travel from the sensing means to the web brake rollers, whereby the amount of the tail having moved past the brake rollers, after the sensing of the approach of the tail, may be adjusted.

7. A web splicer as in claim 3 further comprising a pair of core chucks rotatably mounted on the frame adapted to support and allow rotation of a pair of spools, the webs being in part spirally wound on the spools.

8. A web splicer as in claim 3 in which the web tensioning means comprises a dancer downstream of the hammer and anvil.

9. A web splicer as in claim 8 in which the web tensioning means further comprises a web tensioning carriage mounted to the frame, the dancer being mounted in the carriage, the carriage including a cylinder assembly mounted to the frame and operationally attached to the dancer, the cylinder assembly including a cylinder, a piston in the cylinder, a rod attached to the piston, and means for slidably supporting the rod to the cylinder, the supporting means including a bushing with an annular flange slidably mounted on the rod, a cap on the cylinder defining a clearance for the rod and having a ledge adjacent the clearance, a first annular seal between the flange and ledge, and a second annular seal on the bushing adjacent the flange, opposite the first seal, whereby the rod is flexibly, sealingly supported to the cylinder.

10. A web splicer as in claim 9 in which the piston has a bore with a bore ledge and the cylinder assembly further comprises a washer on the rod, and a third seal between the bore ledge and the washer, the rod being loosely mounted in the bore, whereby the rod is flexibly attached to the piston.

11. A web splicer as in claim 8 in which the web tensioning means further comprises a web tensioning carriage mounted to the frame, the dancer being mounted in the carriage, the carriage including a cylinder assembly mounted to the frame and operationally attached to the dancer, the cylinder assembly including a cylinder, and a piston in the cylinder, the piston having a labyrinth outer, circumferential edge.

12. A method of splicing a leading end of a new web to a tail of an expiring web comprising:

sensing the approach of the tail of the expiring web;

in response to sensing the approach of the tail, braking the tail at a first location;

while the tail is braked, and downstream of the first loaction, pressing the tail and leading end against each other to adhere the tail and leading end to each other; and after the tail and leading end are adhered to each other, releasing the tail.

13. A method as in claim 12 further comprising, before the sensing, applying an adhesive to the leading end such that the leading end is adapted to adhere to the tail.

14. A method as in claim 12 in which the sensing includes sensing the tail leaving a core on which the expiring web had been wound.

15. A method as in claim 14 in which the sensing includes sensing a loss of tension in the expiring web.

16. A method as in claim 12 further comprising applying tension to the tail simultaneous with braking the tail.

17. A method as in claim 12 in which the braking, pressing and releasing are accomplished automatically.

18. A method of splicing a leading end of a new web to a tail of an expiring web, the method utilizing a web splicer comprising a hammer and operatively cooperating anvil, web guides, web brake rollers, means for braking the web brake rollers and simultaneously pressing the web brake rollers against the web guides to supply tension to the expiring web, means for sensing the approach of the tail toward the web brake rollers, and a controller for the web splicer, the expiring web having been running between a first of the web guide rollers and a cooperating first of the web guides, and between the hammer and anvil, the method comprising the steps of:

(a) staging the leading end by, (i) placing an adhesive on the leading end of the new web, (ii) pulling the leading end of the new web between a second of the web guide rollers and a cooperating second of the web guides, and (iii) locating the leading end between the hammer and anvil; and (b) actuating the web splicer for automatic operation by the controller such that, (i) the sensing means automatically senses the approach of the tail toward the web guide rollers, (ii) after the sensing of the approach of the tail, the braking means automatically brakes the web brake rollers and simultaneously supplies tension to the expiring web, (iii) after the braking of the web brake rollers, the hammer automatically hammers the tail to the adhesive on the leading end; and (iv) after the tail is adhered to the leading end, the braking means automatically releases the braking of the web brake rollers, whereby the webs are spliced.

* * * * *